US008875884B1

(12) United States Patent
Lee

(10) Patent No.: US 8,875,884 B1
(45) Date of Patent: Nov. 4, 2014

(54) HAND TOOL RACK

(71) Applicant: Hong-Jen Lee, Taichung (TW)

(72) Inventor: Hong-Jen Lee, Taichung (TW)

( * ) Notice: Subject to any disclaimer, the term of this patent is extended or adjusted under 35 U.S.C. 154(b) by 0 days.

(21) Appl. No.: 14/038,790

(22) Filed: Sep. 27, 2013

(51) Int. Cl.
*B65D 85/28* (2006.01)
*B25H 3/04* (2006.01)

(52) U.S. Cl.
CPC ..... *B25H 3/04* (2013.01)
USPC ..... 206/378; 211/70.6; 211/69; 206/372; 206/493; 206/1.5

(58) Field of Classification Search
USPC ..... 206/378, 493, 303, 1.5, 372, 349, 376, 206/377, 806, 379; 211/70.6, 69, 69.5
See application file for complete search history.

(56) References Cited

U.S. PATENT DOCUMENTS

| | | | | |
|---|---|---|---|---|
| 8,376,153 | B1 * | 2/2013 | Lee | 211/70.6 |
| 8,573,413 | B2 * | 11/2013 | Sh | 211/70.6 |
| 2010/0170817 | A1 * | 7/2010 | Wu | 206/378 |
| 2013/0240394 | A1 * | 9/2013 | Wang | 206/372 |

* cited by examiner

*Primary Examiner* — Anthony Stashick
*Assistant Examiner* — Raven Collins

(57) ABSTRACT

A hand tool rack includes a first body and a second body. The first body has two rectangular extensions and a connection member which is located between the two extensions. Each extension has a first connection portion. The connection member has a second connection portion. Multiple first positioning portions are located between the two first connection portions. The second body has two first holes defined through two first portions on two ends thereof. The second body has a second hole defied through a second portion at the middle portion thereof. When the first connection portions extend through the first holes, the first connection portions contact respective tops of the first portions. The second connection portion extends through the second hole and contacts the second portion. The first positioning portions are connected with the second positioning portions of the second body.

9 Claims, 11 Drawing Sheets

HAND TOOL RACK

FIELD OF THE INVENTION

The present invention relates to a tool rack, and more particularly, to a hand tool rack with safety feature and comprising two bodies connected at three positions to each other. The three positions have to be cut to separate the two bodies and take the tools.

BACKGROUND OF THE INVENTION

The conventional tool rack is disclosed in U.S. Pat. No. 6,092,656 and generally comprises a body with an accommodating area and multiple extensions are located in the accommodating area. The body has two tapered first connection portions on two ends thereof. A connector is made to match the length of the body and has second connection portions which are slots defined in the top and bottom ends, such that the first connection portions are engaged with the second connection portions to form the tool rack. The connector has multiple blocks on one side thereof and located corresponding to the extensions. The tool has one end connected to the block and the other end is connected to the extension. The first and second connection portions are connected to each other by extending the front ends of the first connection portions through the second connection portions, such that the tool rack has a proper safety feature. When the customer purchases the tool rack, he or she has to cut the first and second connection portions so as to pick the tool out. However, there are only the two positions are connected to each other between the body and the connector, and this is not safety enough. Besides, when the body and the connector both have a certain length in order to accommodate more tools, the two connection portions between the body and the connector are easily broken.

The present invention intends to provide a hand tool rack which improves the shortcomings of the conventional tool rack.

SUMMARY OF THE INVENTION

The present invention relates to a hand tool rack and comprises a first body which is integrally made by plastic and has two rectangular extensions respectively located on two ends thereof. Each extension has a first connection portion and each connection portion is a ball which has slot defined therein. Each of the extensions has a first side. The two respective extensions, the two first connection portions and the two first sides are located corresponding to each other. The first body has a connection member which is located between the two extensions. A second connection portion is connected to the connection member and is a ball which has a slot defined therein. The first and second connection portions are identical and located on the same height. Multiple first positioning portions are located between the two first connection portions.

A second body is integrally made by plastic and has two first holes respectively defined in two ends thereof. The first holes are two circular holes. Each of the first holes is defined through a first portion of the second body. When the first connection portions extend through the first holes, the first connection portions contact respective tops of the first portions. Each of the first portions has a second side which contacts the first side. The second body has a second hole which is a circular hole. The second hole is defined through a second portion. The second connection portion extends through the second hole and contacts the second portion. The first and second connection portions secure the second body to the first body. The second body has multiple second positioning portions. Each second positioning portion is located corresponding to the first positioning portion corresponding thereto.

A tool has a first end and a second end. The first end of the tool is connected to the first positioning portion. The second end of the tool is connected to the second positioning portion. The first end of the tool is connected to the first body and the second end of the tool is connected to the second body.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
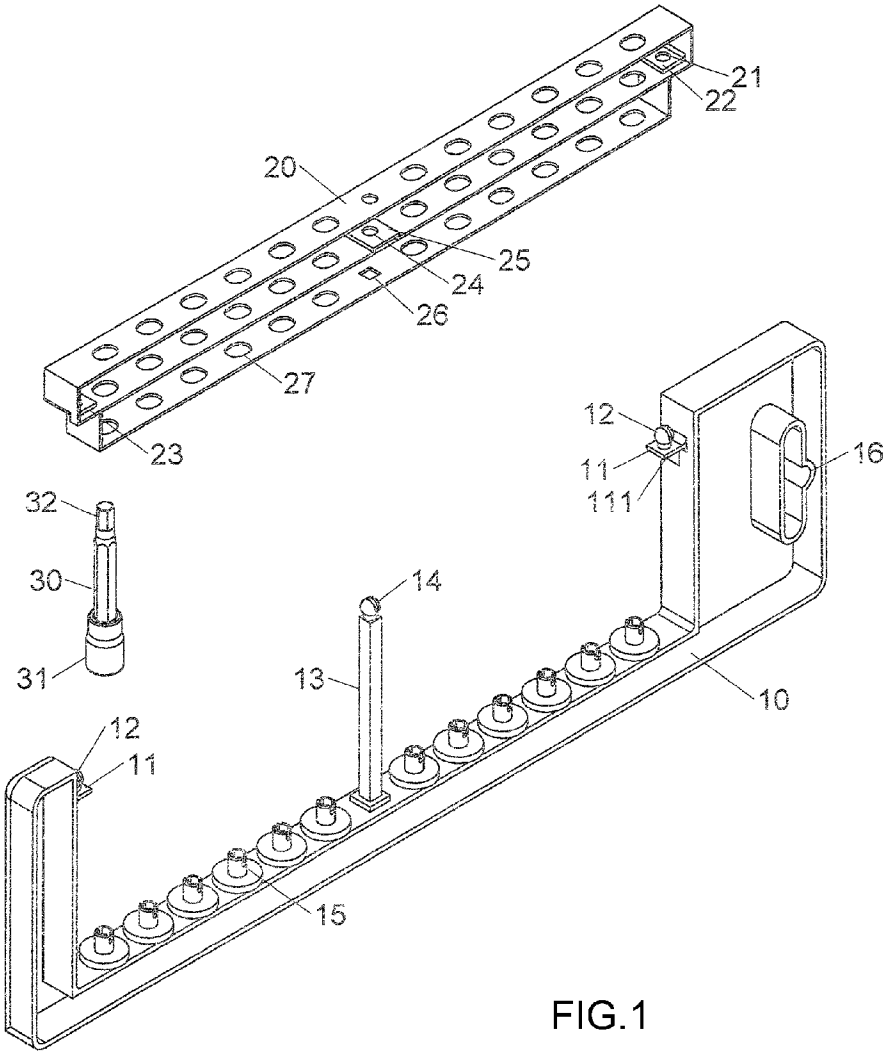
FIG. 1 is an exploded view to show the hand tool rack of the present invention.

Referring to FIGS. 1 to 5, the hand tool rack of the present invention comprises a first body 10 and a second body 20. The first body 10 is integrally made by plastic and has two rectangular extensions 11 respectively located on two ends thereof. Each extension 11 has a first connection portion 12 and each connection portion 12 is a ball which has slot defined therein. Each of the extensions 11 has a first side 111. The two respective extensions 11, the two first connection portions 12 and the two first sides 111 are located corresponding to each other. The first body 10 has a connection member 13 which is located between the two extensions 11. A second connection portion 14 is connected to the connection member 13 and is a ball which has a slot defined therein. The first and second connection portions 12, 14 are identical and located on the same height. Multiple first positioning portions 15 are located between the two first connection portions 12 and each first position portion 15 is a rectangular recess for positioning a hand tool 30. The first body 10 has a grasp hole 16 defined in one end thereof so that the hand tool rack can be hanged or lifted by using the grasp hole 16.

The second body 20 is integrally made by plastic and has two first holes 21 respectively defined in two ends thereof. The first holes 21 are two circular holes. Each of the first holes 21 is defined through a first portion 22 of the second body 20. When the first connection portions 12 extend through the first holes 21, the first connection portions 12 contact respective tops of the first portions 22. Each of the first portions 22 has a second side 23 which contacts the first side 111. The second body 20 has a second hole 24 which is a circular hole. The second hole 24 is defined through a second portion 25. The second connection portion 14 extends through the second hole 24 and contacts the second portion 25. A third hole 26 is defined in the second body 20 and located beneath the second hole 24. The connection member 13 extends through the third hole 26 and the second connection portion 14 extends through the second hole 24. The second connection portion 14 contacts the top of the second portion 25 so as to connect the second body 20 to the first body 10. The connections between the first and second connection portions 12, 14 secure the second body 20 to the first body 10. The second body 20 has multiple second positioning portions 27, and each second positioning portion 27 is located corresponding to the first positioning portion 15 corresponding thereto.

The tool 30 has a first end 31 and a second end 32. The first end 31 of the tool 30 is connected to the first positioning portion 15, and the second end 32 of the tool 30 is connected to the second positioning portion 27. In other words, the first end 31 of the tool 30 is connected to the first body 10 and the second end 32 of the tool 30 connected to the second body 20. The first end 31 of the tool 30, such as a socket, an adapter, an extension connector, is a rectangular recess and the first positioning portion 15 is a rectangular protrusion. The hand tool 30 is secured between the first and second bodies 10, 20 and has anti-theft feature.

Figure 2:
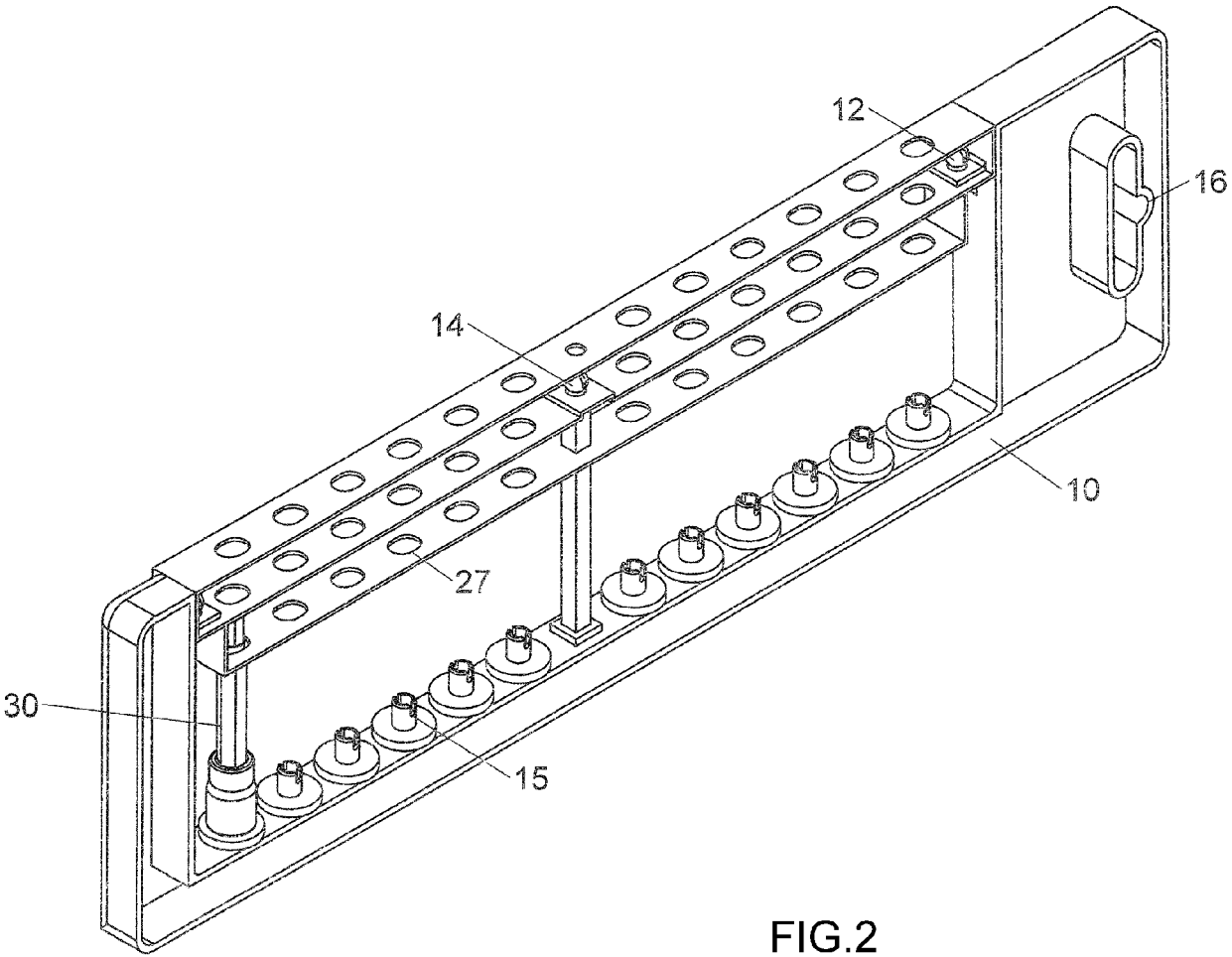
FIG. 2 is a perspective view to show the hand tool rack of the present invention.
Figure 4:
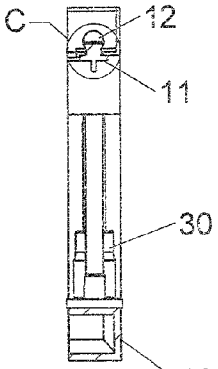
FIG. 4 is a cross sectional view, taken along line B-B in FIG. 3.

As shown in FIG. 2, when the second body 20 and multiple tools 30 are connected to the first body 10, the first connection portions 12 are engaged with the first holes 21, and the first connection portions 12 contacts the first portions 22. The connection member 13 extends through the third hole 26 and the second connection portion 14 extends through the second hole 24. The second connection portion 14 contacts the second portion 25. Therefore, the first and second bodies 10, 20 are securely connected to each other, and at least three anti-theft structures are located at three positions of the hand tool rack.

Figure 5:
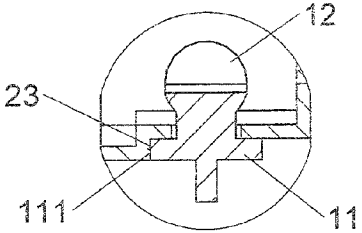
FIG. 5 is an enlarged view of the circled portion "C" in FIG. 4.
Figure 3:
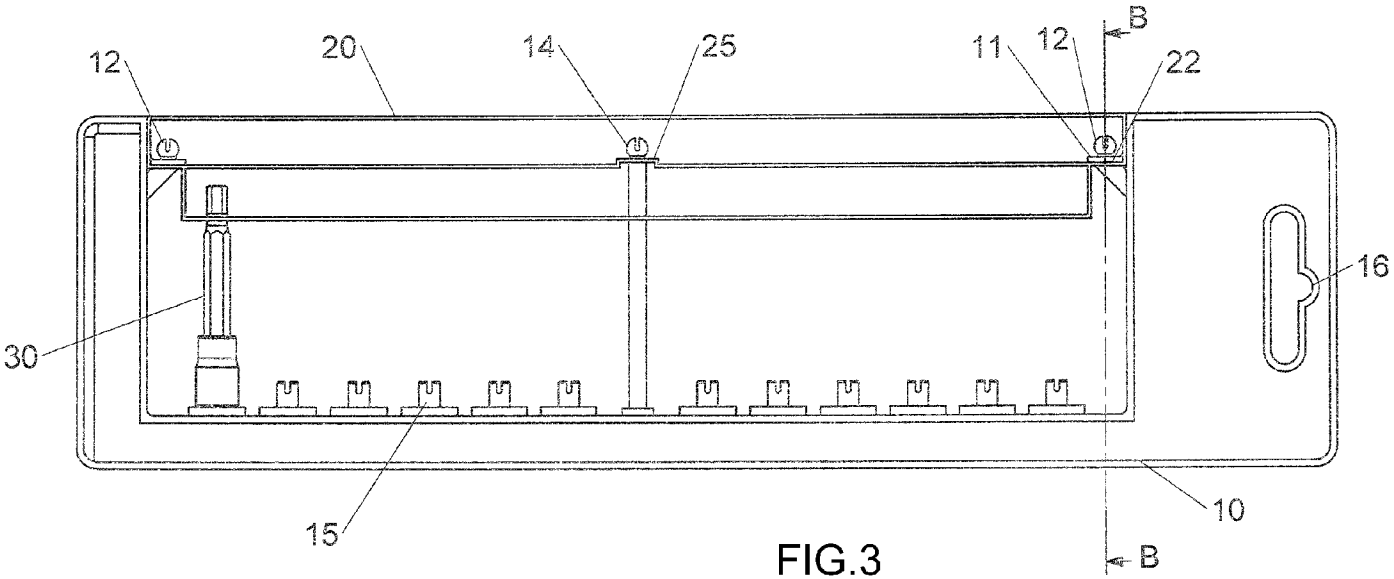
FIG. 3 is a front view of the hand tool rack of the present invention.

As shown in FIG. 5, the second sides 23 contact the first side 111 of the extensions 11, and the first connection portions 12 are connected to the first portions 22 to form dual safety features.

Figure 6:
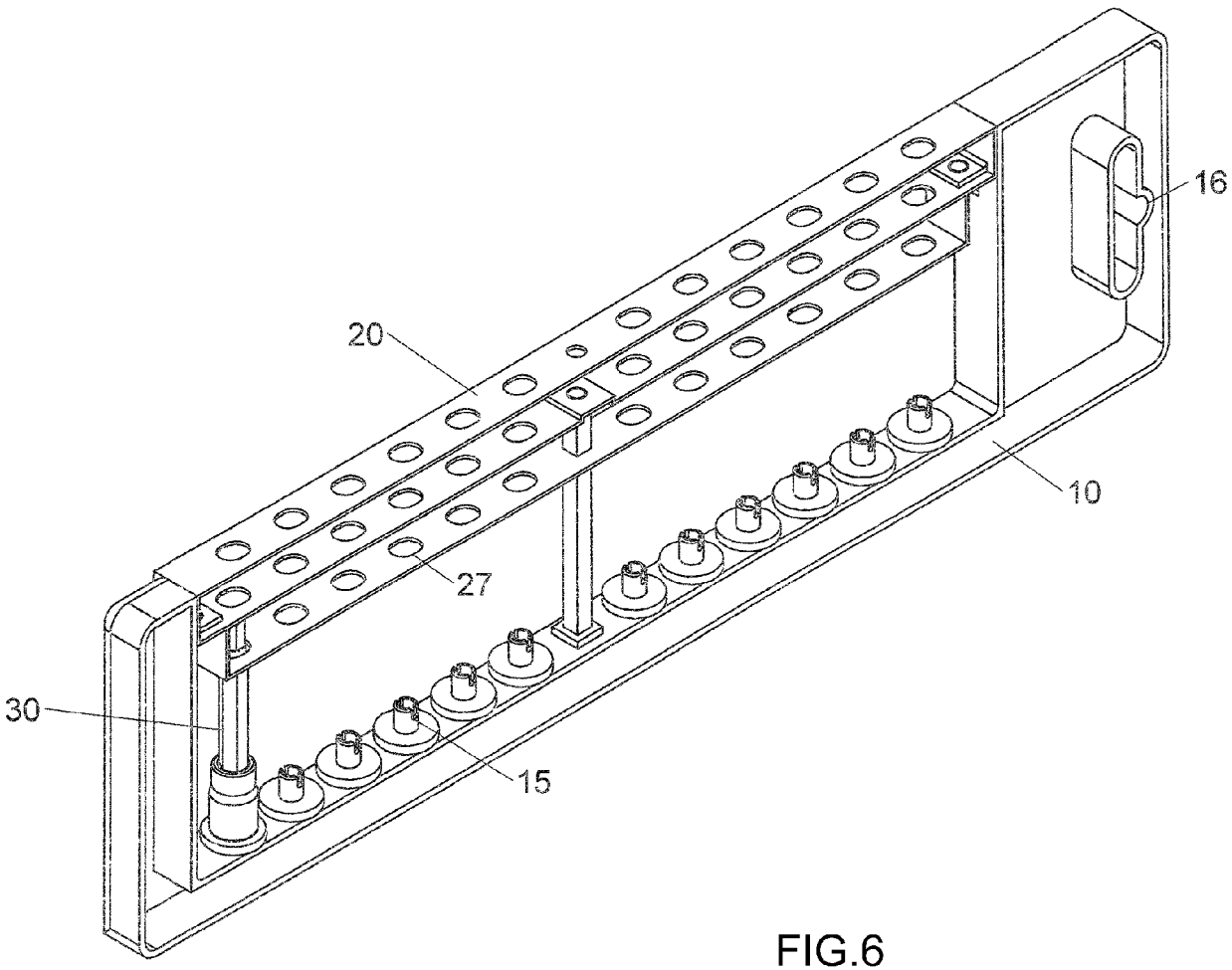
FIG. 6 shows the hand tool rack of the present invention wherein the first connection portions are cut.

As shown in FIG. 6, the first and second connection portions 12, 14 are cut, and the second body 20 is lifted upward a distance so that the tools 30 can be accessed.

Figure 7:
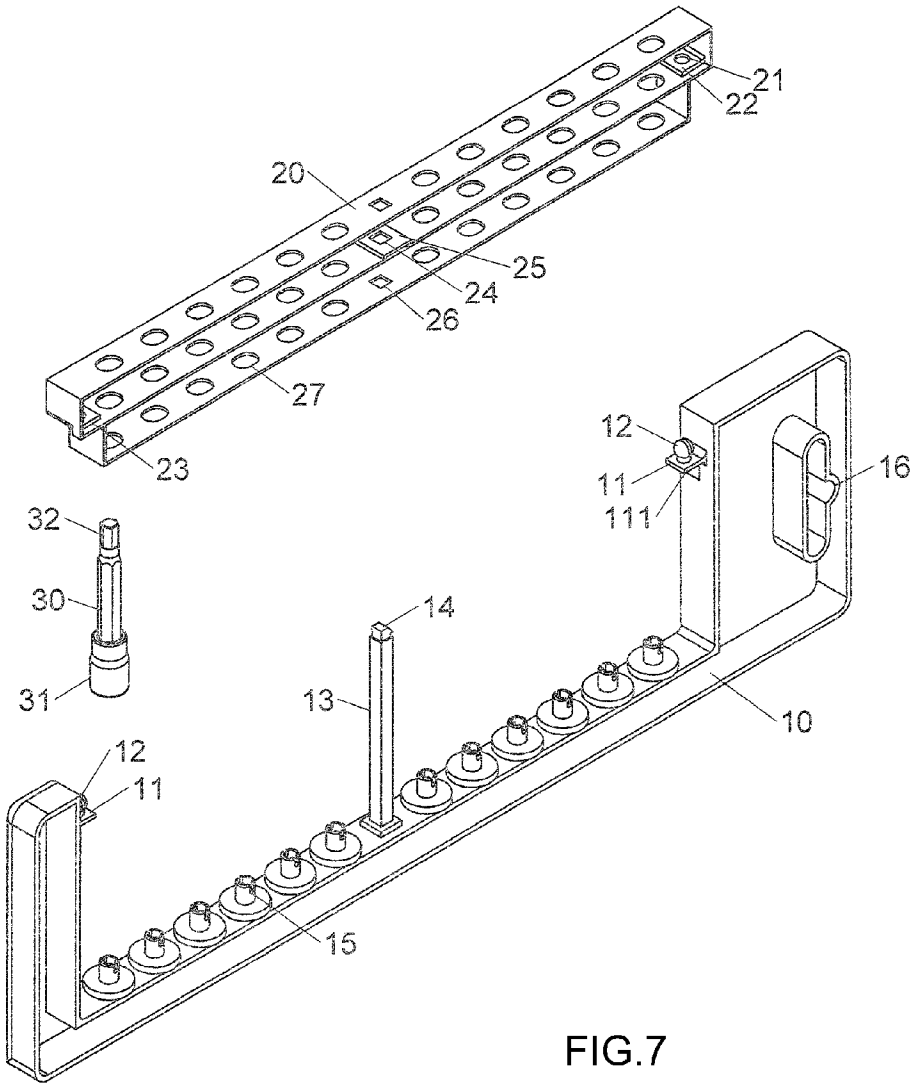
FIG. 7 is an exploded view to show the second embodiment of the hand tool rack of the present invention.

As shown in FIG. 7, the second embodiment shows that the second connection portion 14 is a hook and the second hole 24 is a rectangular hole. The first connection portion 12 of the first body 10 is a ball with the slot, or the width of the slot is wide enough. When the second connection portion 14 is cut, the first portion 22 of the second body 20 is separated from the first connection portion 12 of the first body 10 by an upward force. When re-assemble the hand tool rack, the second body 20 is pressed into the first body 10 to connect the first connection portion 12 to the first portion 22. Therefore, the second body 20 can be used repeatedly and does not waste material.

Figure 8:
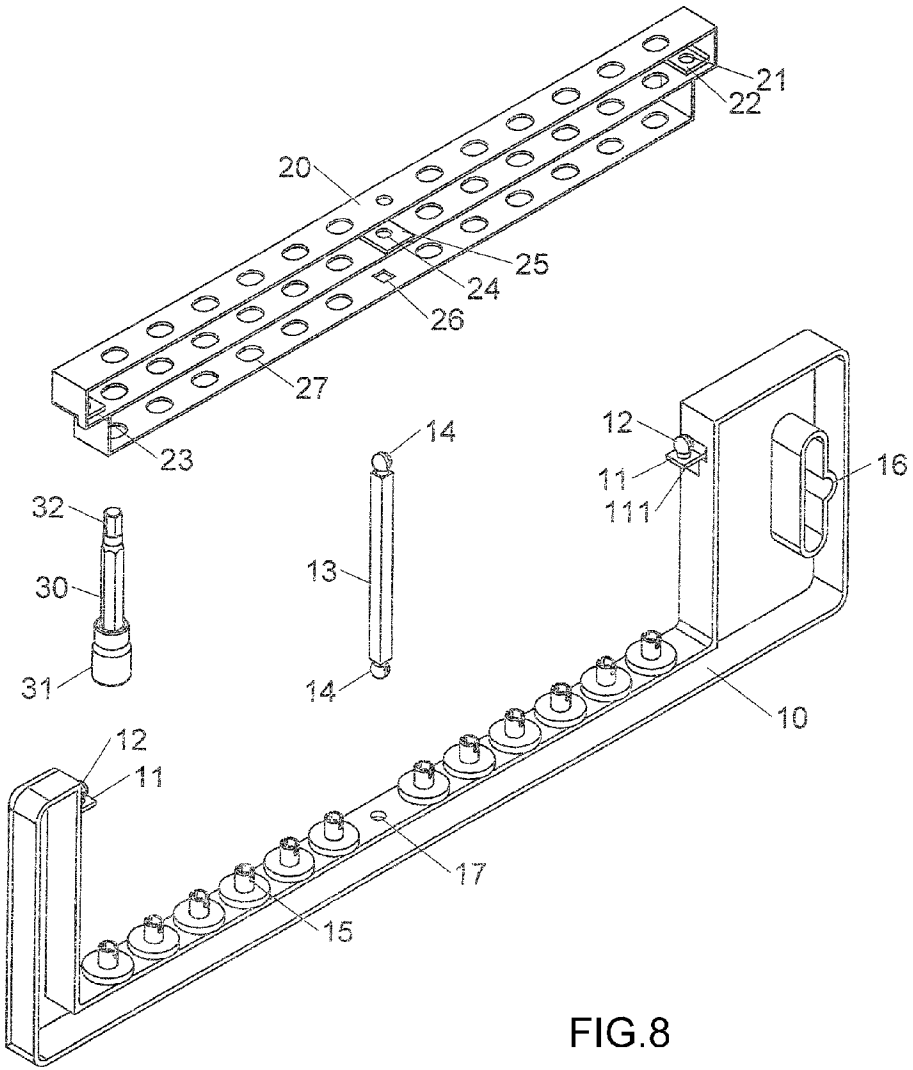
FIG. 8 is an exploded view to show the third second embodiment of the hand tool rack of the present invention.

As shown in FIG. 8, the third embodiment shows that the connection member 13 is a single member and two second connection portions 14 are connected to two ends of the connection member 13. The first body 10 has a fourth hole 17 defined in the middle portion thereof, and one of the two second connection portions 14 is engaged with the fourth hole 17.

Figure 9:
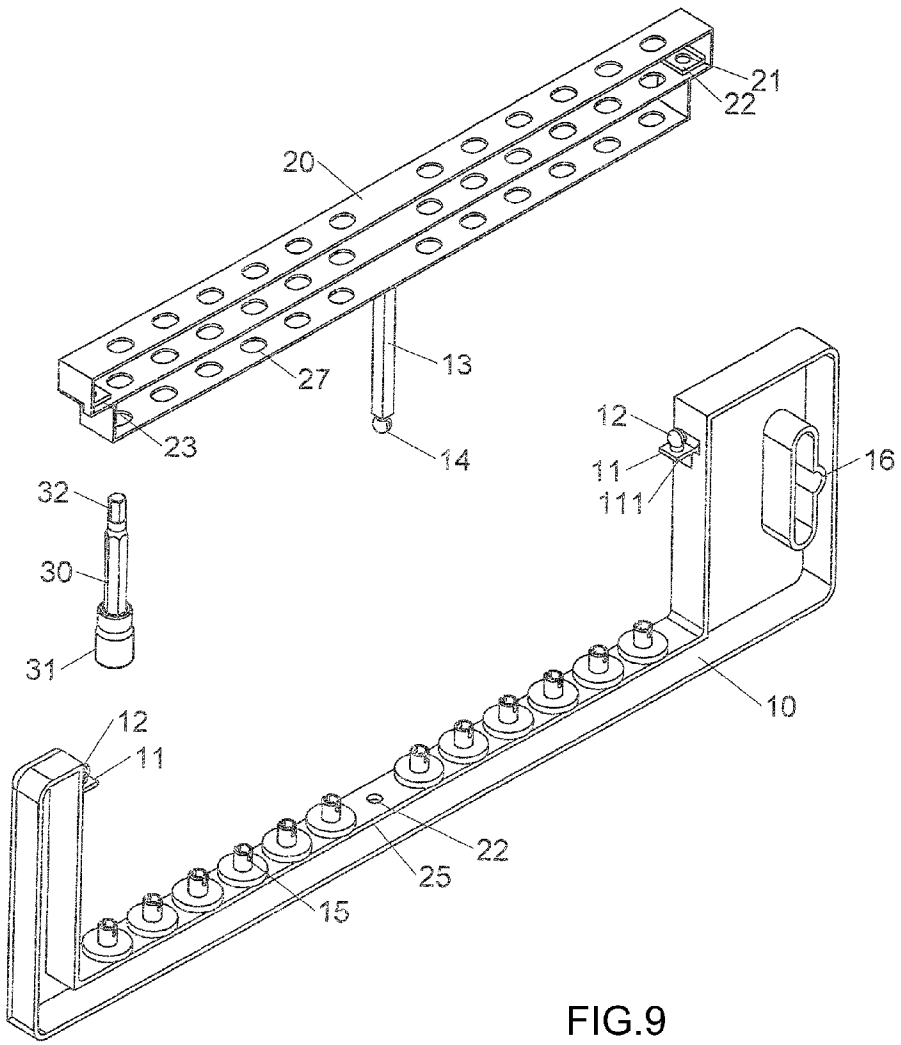
FIG. 9 is an exploded view to show the fourth embodiment of the hand tool rack of the present invention.

As shown in FIG. 9, the fourth embodiment shows that the connection member 13 and the second body 20 are formed integrally as a single part, the second hole 24 and the second portion 25 are located in the first body 10. The disclosure in FIG. 9 is reverse to that shown in FIG. 1.

Figure 10:
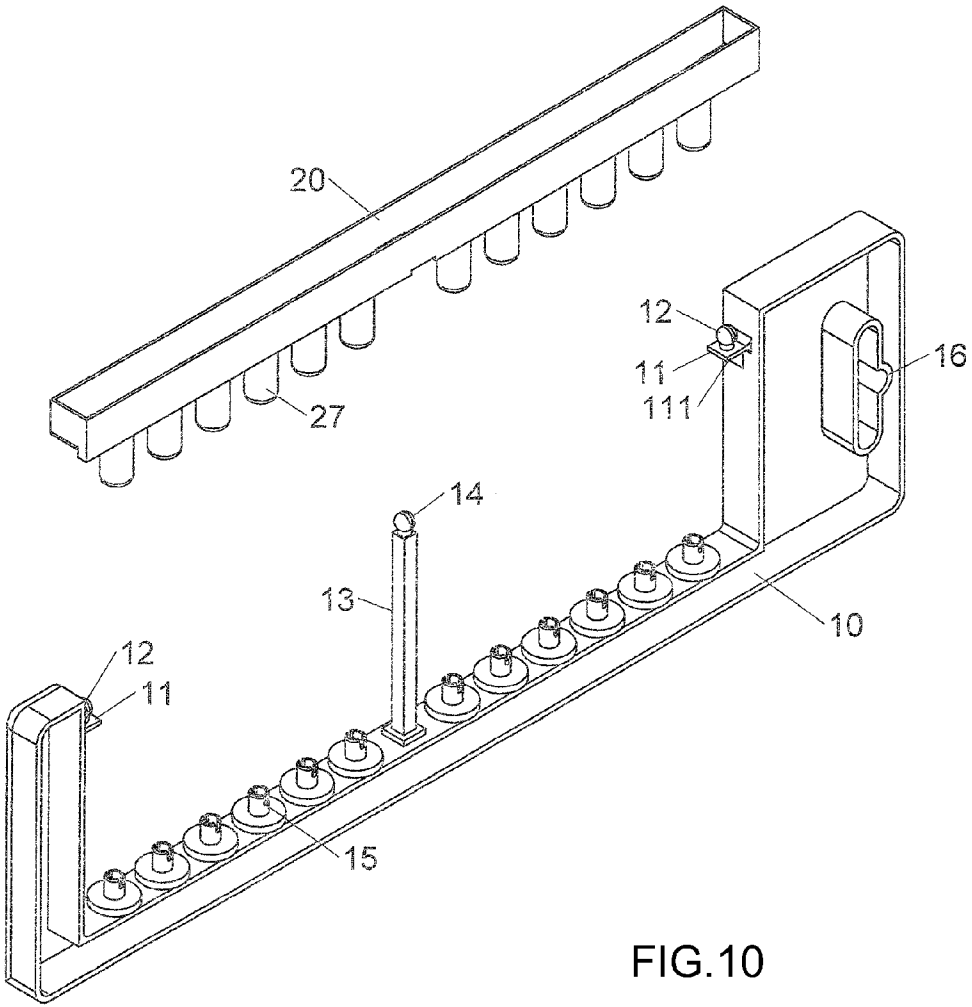
FIG. 10 is an exploded view to show the fifth embodiment of the hand tool rack of the present invention.
Figure 11:
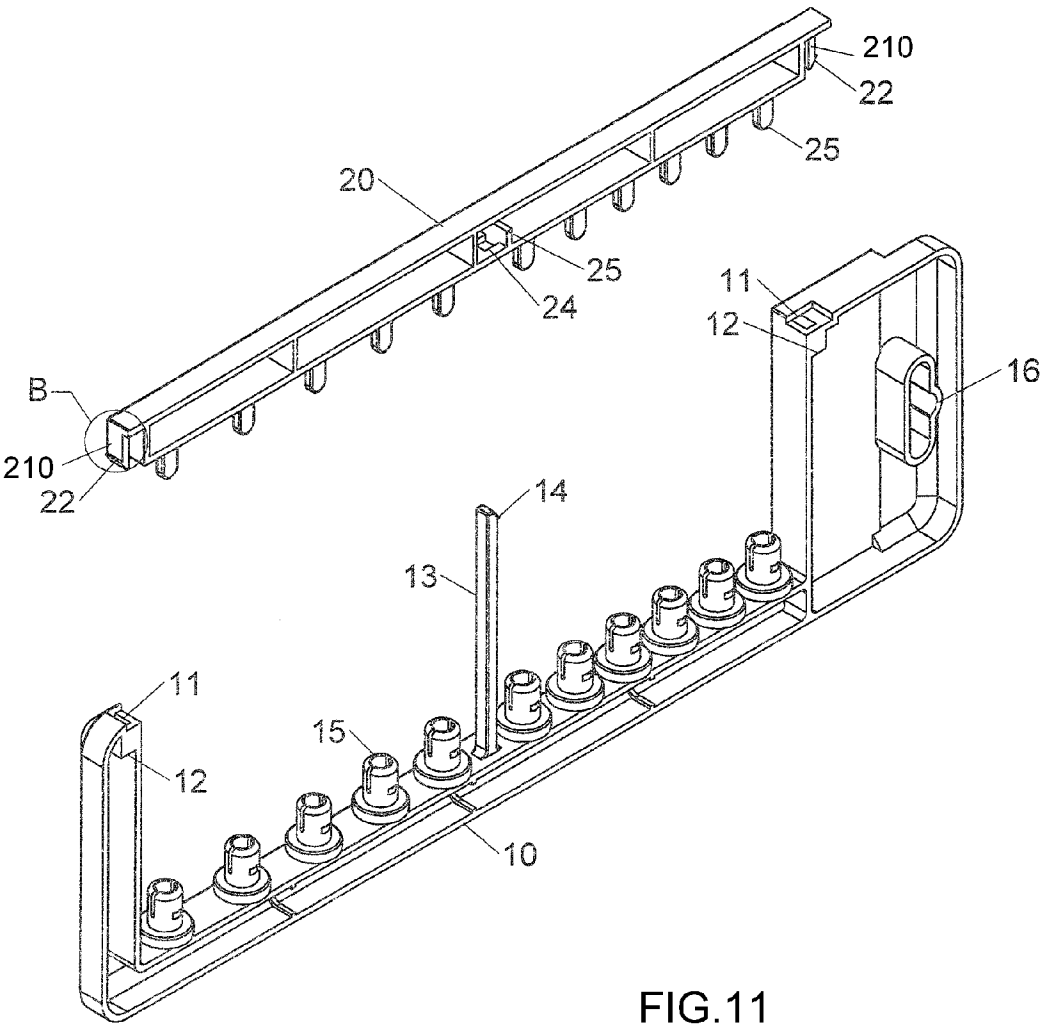
FIG. 11 is an exploded view to show the sixth embodiment of the hand tool rack of the present invention.
Figure 12:
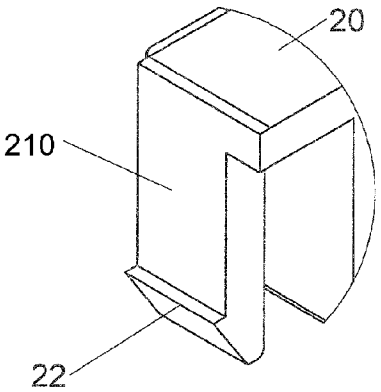
FIG. 12 is an enlarged view of the circled portion "B" in FIG. 11.
Figure 13:
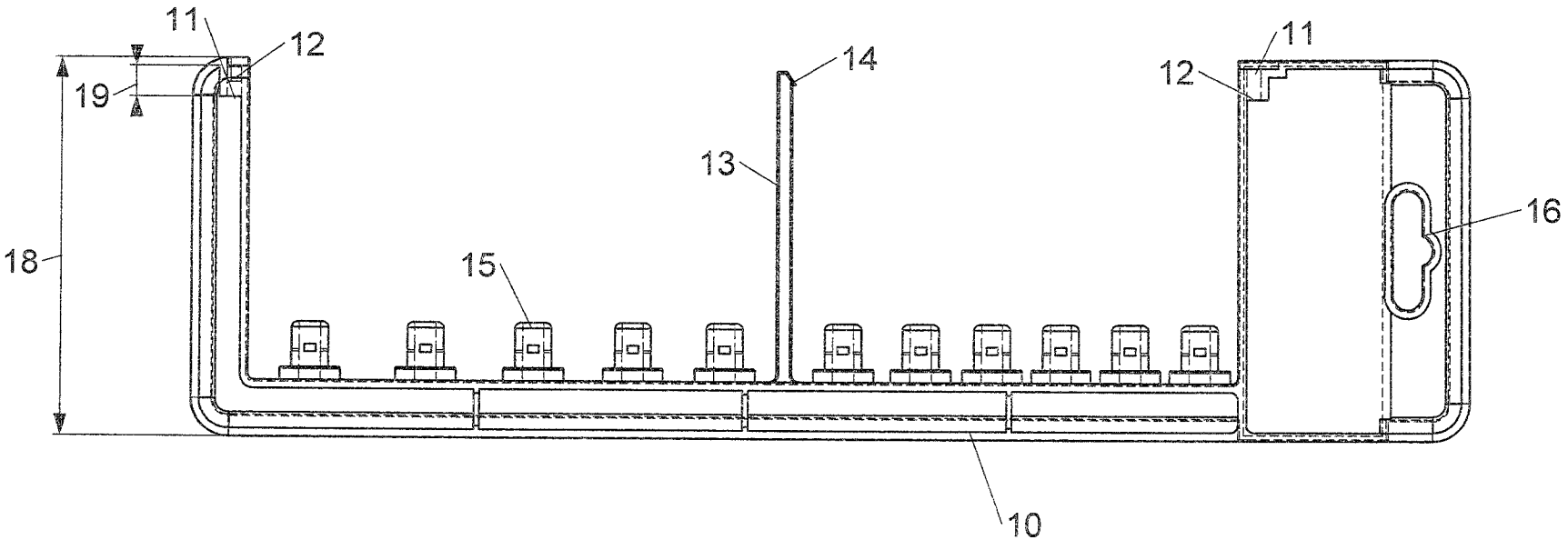
FIG. 13 is a front view of the first body of the sixth embodiment of the present invention.
Figure 14:
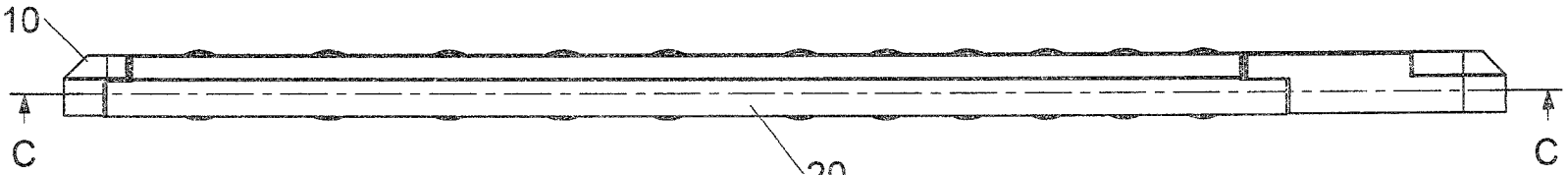
FIG. 14 is a front view of the sixth embodiment of the hand tool rack of the present invention.
Figure 15:
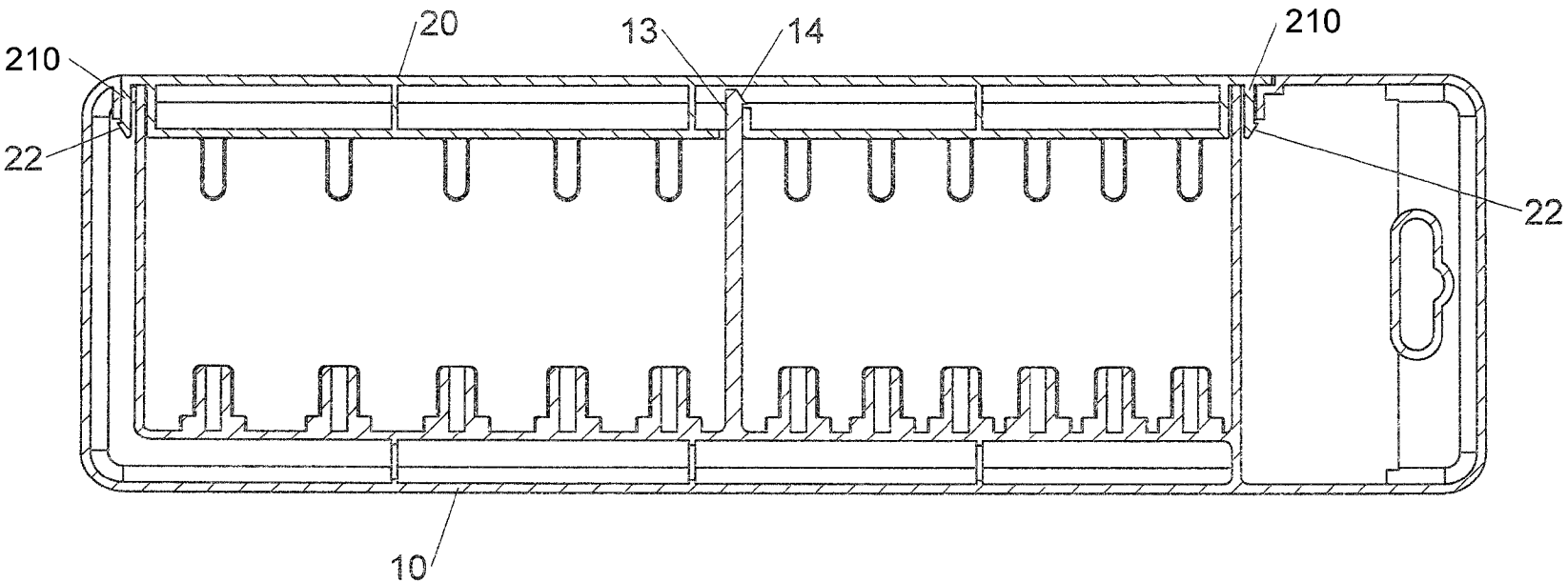
FIG. 15 is a cross sectional view, taken along line C-C in FIG. 14.

As shown in FIG. 10, the fifth embodiment shows that the second body 20 is an elongate body and the second positioning portions 27 are tubular portions.

As shown in FIGS. 11 to 15, the sixth embodiment shows that the two extensions 11 of the first body 10 are a hook extension, and the first connection portions 12 are a space. The first body 10 has a first length 18 and the first connection portions 12 has a second length 19 which is more than 5% of the first length 18. The second length 19 is 8% to 12% of the first length 18. The second connection portion 14 is a hook and the second body 20 has two first connection pieces 210 extending from two ends thereof. The first connection pieces 210 replace the first holes 21. The first connection pieces 210 each are flexible and have a first portion 22 which is a hook. The first portions 22 are engaged with the first connection portions 12.

Along with different types of the tools 30, the first end 31 and the second end 32 of the tool 30 may vary. The first positioning portions 15 and the second positioning portions 27 are designed to secure the first and second ends 31, 32 of the tools.

When the first body 10 is longer, the number of the connection member 13 and the second connection portions 14 can be increased, while the second hole 24, the second portion 25 and the third hole 26 can also be increased accordingly. The multiple connection members 13, the multiple second connection portions 14, the multiple second holes 24, the multiple second portions 25 and the multiple third holes 26 are located linearly to each other.

The advantages of the present invention are that:

The first connection portions 12 and the second connection portion 14 are connected to the first body 10 so that the tools 30 connected to the first positioning portions 15 are safely secured.

The first connection portions 12 and the second connection portion 14 are connected to the first body 10 so that the second body 20 is secured to the first body 10, and the hand tool rack has three safety mechanisms to provide well safety feature.

When the first end 31 of the tool 30 is connected to the first positioning portion 15 of the first body 10, and the second end 32 of the tool 30 is connected to the second positioning portion 27 of the second body 20, the tool 30 is well positioned between the first and second bodies 10, 20.

The first and second connection portions 12, 14 each are a ball with a slot so that the first body 10 is easily disengaged from the mold without using slides, so that the cost for the molds can be reduced.

While we have shown and described the embodiment in accordance with the present invention, it should be clear to those skilled in the art that further embodiments may be made without departing from the scope of the present invention.

What is claimed is:

1. A hand tool rack comprising:

a first body being integrally made by plastic and having two rectangular extensions respectively located on two ends thereof, each extension having a first connection portion and each connection portion being a ball which has slot defined therein, each of the extensions having a first side, the two respective extensions, the two first connection portions and the two first sides being located corresponding to each other, the first body having a connection member which is located between the two extensions, a second connection portion connected to the connection member and being a ball which has a slot defined therein, the first and second connection portions being identical and located on the same height, multiple first positioning portions located between the two first connection portions;

a second body being integrally made by plastic and having two first holes respectively defined in two ends thereof, the first holes being two circular holes, each of the first holes being defined through a first portion of the second body, when the first connection portions extend through the first holes, the first connection portions contact respective tops of the first portions, each of the first portions having a second side which contacts the first side, the second body having a second hole which is a circular hole, the second hole defined through a second portion, the second connection portion extending through the second hole and contacting the second portion, the first and second connection portions securing the second body to the first body, the second body having multiple second positioning portions, each second positioning portion located corresponding to the first positioning portion corresponding thereto, and a tool having a first end and a second end, the first end of the tool connected to the first positioning portion, the second end of the tool connected to the second positioning portion, the first end of the tool connected to the first body and the second end of the tool connected to the second body.

2. The hand tool rack as claimed in claim 1, wherein the first end of the tool is a rectangular recess and the first positioning portion is a rectangular protrusion, the first body has a grasp hole.

3. The hand tool rack as claimed in claim 1, wherein a third hole is defined in the second body and located beneath the second hole, the connection member extends through the third hole and the second connection portion extends through the second hole, the second connection portion contacts a top of the second portion.

4. The hand tool rack as claimed in claim 1, wherein the second positioning portions each are a recess.

5. The hand tool rack as claimed in claim 1, wherein the second connection portion is a hook and the second hole is a rectangular hole, the first connection portion of the first body is a ball with the slot, the second connection portion is cut to separate the first portion of the second body is separated from the first connection portion of the first body, the second body is pressed into the first body to connect the first connection portion to the first portion.

6. The hand tool rack as claimed in claim 1, wherein the connection member is a single member and two second connection portions are connected to two ends of the connection member, the first body has a fourth hole with which one of the two second connection portions is engaged.

7. The hand tool rack as claimed in claim 1, wherein the connection member and the second body are integrally formed each other, the second hole and the second portion are located in the first body.

8. The hand tool rack as claimed in claim 1, wherein the second body is an elongate body and the second positioning portions are tubular portions.

9. The hand tool rack as claimed in claim 1, wherein the first body has multiple connection members and multiple second connection portions, the second body has the same number of the second holes and second portions, the connection members, the second connection portions, the second holes and the second portions are located linearly to each other.

* * * * *